United States Patent [19]

DeBortoli et al.

[11] Patent Number: 4,652,071

[45] Date of Patent: Mar. 24, 1987

[54] CABLE TERMINAL CONNECTOR WITH INSULATION DISPLACING TERMINALS

[75] Inventors: George DeBortoli; Remo Contardo, both of Ottawa; Sharanjit S. Aujla, Kanata, all of Canada

[73] Assignee: Northern Telecom Limited, Montreal, Canada

[21] Appl. No.: 721,258

[22] Filed: Apr. 8, 1985

[51] Int. Cl.[4] ..... H01R 11/20

[52] U.S. Cl. ..... 339/99 R; 339/98; 339/198 G

[58] Field of Search ..... 339/97 R, 97 P, 98, 339/99 R, 103 R, 151 R, 151 M, 151 C, 154 R, 174, 198 G, 198 GA, 206 R, 268 R, 272 R, 272 A

[56] References Cited

U.S. PATENT DOCUMENTS 4,002,391 1/1977 Dunn et al. ..... 339/98

4,210,379 7/1980 Vachhani et al. ..... 339/198 G 4,449,777 5/1984 Baribeau ..... 339/99 R 4,597,623 7/1986 Krumreich ..... 339/97 P

*Primary Examiner*—Gil Weidenfeld

*Assistant Examiner*—Paula A. Austin

*Attorney, Agent, or Firm*—Sidney T. Jelly

[57] ABSTRACT

A connector, for use for connection of local conductors to a distribution cable, in telephone systems, has an elongate body in which are a plurality of recesses. Insulation displacing terminals are positioned in the recesses, the lower part of each terminal connecting to a cable conductor. Connector members are pushed into the recesses by a trapped screw in each connector member. Local conductors are inserted into transverse passages or bores and as a connector member is pushed down, the top ends of the terminals pass up into the connector member and make contact with the conducitve cores of the conductors.

20 Claims, 27 Drawing Figures

CABLE TERMINAL CONNECTOR WITH INSULATION DISPLACING TERMINALS

This invention relates to a cable terminal connector, with insulation displacing terminals. Such a connector is used for aerial connection of local cable conductors to a distribution cable. The connector can also be used in a pedestal, or underground.

In particular the invention provides a connector which can be fitted in place of conventional connectors in which connection is made by tightening a nut on a terminal on to a conductor, the core of which has been previously cleaned of insulation. Conductors from the main distributing cable are normally connected to rear ends of the terminals by various methods and then potted, that is embedded in a potting compound.

In the present invention, the conductors from the main distributing cable are pushed into a bore in the connector. Terminals are then pushed in, and connection is made between terminal and conductor by displacement of insulation. A sealant gel can then be injected to enclose the connections between terminals and conductors. Associated with each pair of conductors from the main cable is a connecting member which is mounted on the connector. Conductors from the local cable are pushed into bores in the connecting members, a pair to each connecting member. The connecting member is then pushed into a connecting position which forces the conductors into the terminals, displacing insulation.

The invention will be readily understood by the following description of certain embodiments, by way of example, in conjunction with the accompanying drawings, in which.

Figure 1:
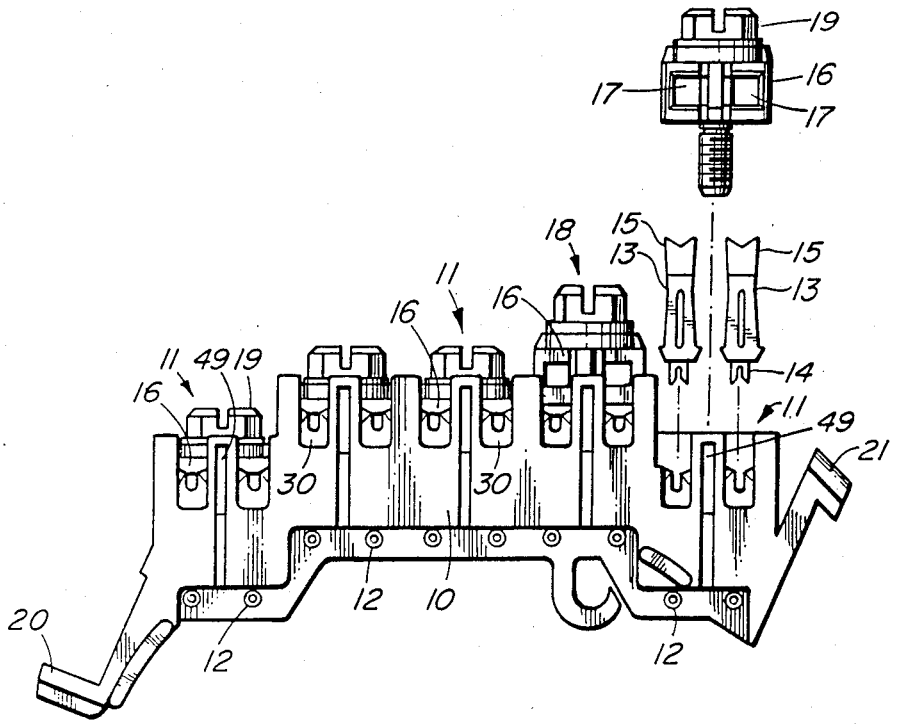
FIG. 1 is a front view, somewhat diagrammatic, of a connector, with one terminating position shown in exploded view.

FIG. 1 illustrates a connector suitable for mounting in an existing form of housing, and used generally for making connections of drop wires to a cable, the drop wires being the local connections to customers premises. The housing, in the particular example is cylindrical and the cable conductors usually enter at one end. A plurality of connectors are usually mounted in one housing.

As illustrated in FIG. 1, a connector comprises a connector body 10, having a plurality of connection positions, indicated at 11. Beneath each position 11, two holes 12 provide for insertion of conductors from the cable. As illustrated at the right of FIG. 1, at each position 11 there are two terminals 13, the lower ends 14 of which connect to the conductors inserted into holes 12. The upper ends 15 of the terminals 13 are in recesses in the connector body 10, into which fit connecting members 16. Passageways 17 in the connector members admit the ends of drop wire connectors. In an initial position of the connector members, as illustrated at 18, the passageways 17 are above and clear of the upper ends of the terminals 13. After insertion of drop wire conductors into the passageways 17, the connector member 16 is tightened down, by screw 19, forcing the conductors into the upper ends of the terminals. Extensions 20 and 21 at the ends of the body 10, provide for attachment to the main housing.

Figure 2:
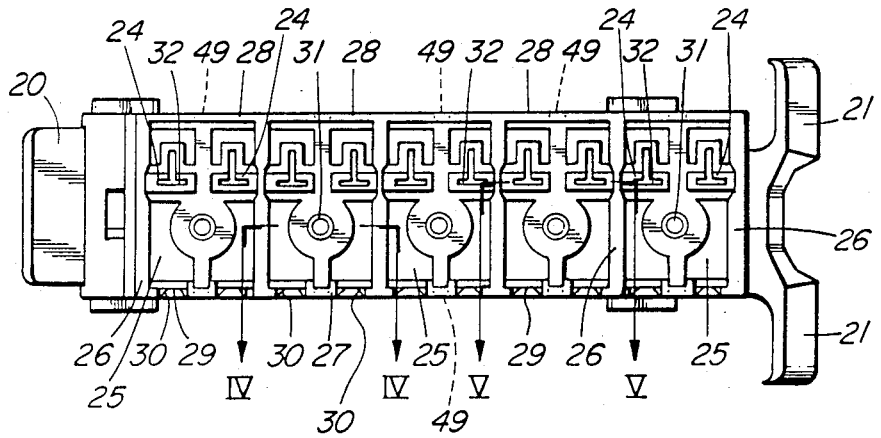
FIG. 2 is a top plan view of a connector body.
Figure 3:
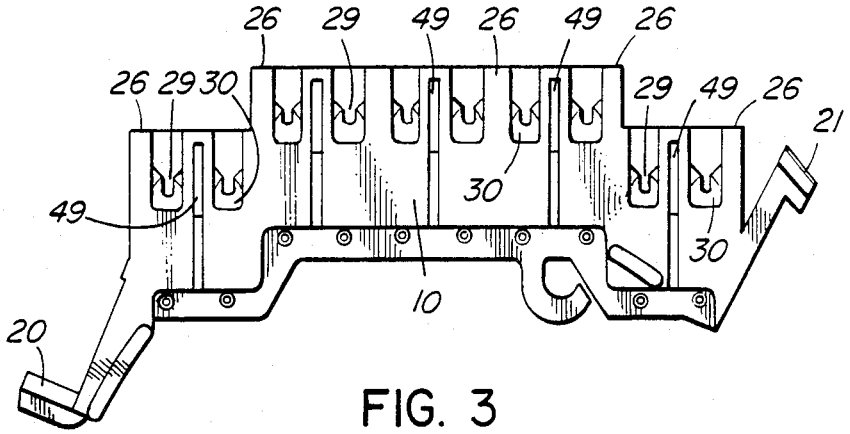
FIG. 3 is a front view of the connector body in FIG. 2.

FIGS. 2 and 3 illustrate the connector body 10. FIG. 3 is similar to FIG. 1, with the connector members removed. In FIG. 2 recesses 25 are shown into which the connector members are inserted. The recesses are defined by transverse walls or ribs 26 which extend across the body, and front and rear walls 27 and 28 respectively. The front wall has a plurality of slots 29 formed in it, extending down from its top edge, a pair of slots for each recess 25. The lower parts of slots, in the example, have chamfered edges 30, which cut into the insulation wiring the conductor core and act as strain reliefs for the conductors inserted into the connector members.

Figure 4:
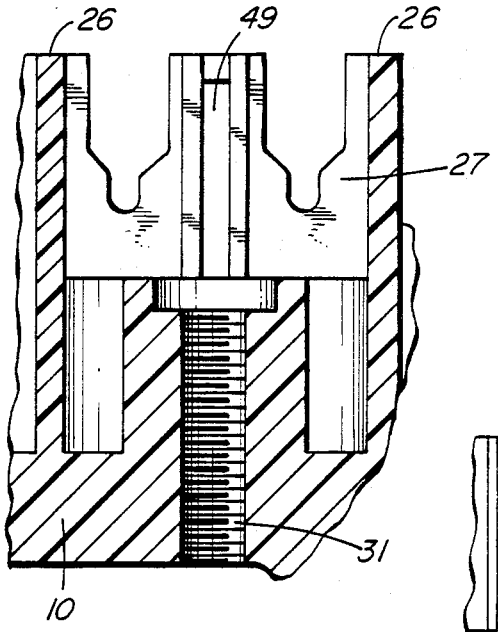
FIGS. 4 and 5 are cross-sections on the lines IV—IV and V—V respectively, on FIG. 2.
Figure 5:
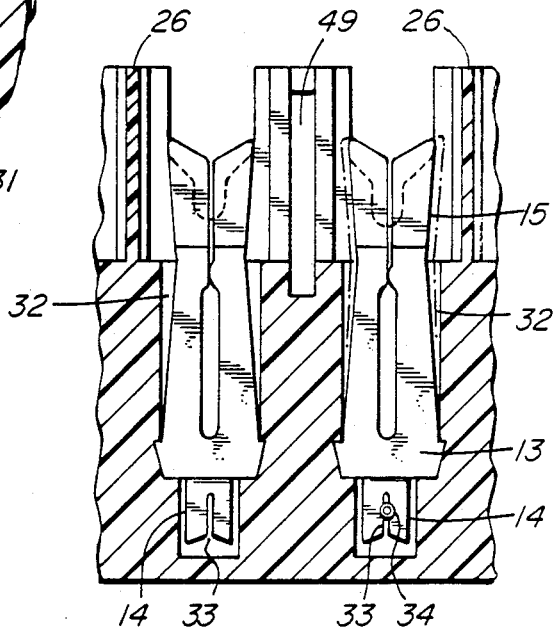
Figure 6:
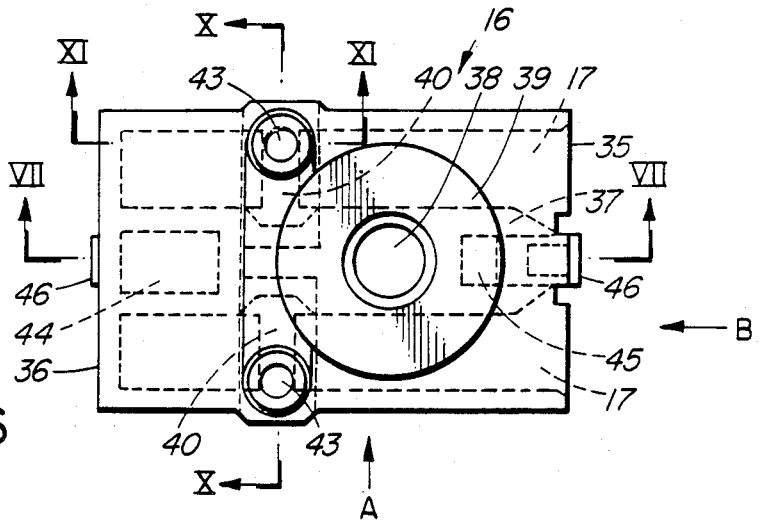
FIG. 6 is a top plan view of a connecting member.

In the base of each recess is a boss having a threaded bore 31, seen also in FIG. 4. The screw 19, shown in FIG. 1, screws into this bore to tighten down the connecting member 16. Also formed in the base of each recess is a pair of slots 32, in the example, T-shaped. The terminals 13 are positioned in the slots, as seen in FIG. 5. In normal use, the terminals 13 are inserted from the top of the body, being supported in bosses 24 extending up from the base, after conductors have been pushed into the holes 12, with the lower parts 14 being pushed down onto the conductors As the conductors enter slots 33 in the lower parts 14, insulation is displaced and direct contact occurs between the conductive core of the conductor and the terminal. This is illustrated at the right-hand side of FIG. 5, the conductor indicated at 34.

FIGS. 6 to 11 illustrate a connector member. A connector member is rectangular in plan form and has two rectangular passages 17 extending in from a front face 35 almost to the back face 36, the passages separated by a central wall 37. Extending through the central wall is a bore 38 in which is positioned the screw 19—FIG. 1. A circular seating 39 is provided on the top surface of the connecting member, on which rests the head of the screw.

At a position intermediate the front and back faces, in the example closer to the back face, are two rectangular slots 40 which extend up from the bottom face 41 of the member, almost to the top face 42. The slots 40 intersect the passages 17. Two small holes 43 extend through from the top face 42 to the slots 40, a hole 43 communicating with each slot. Two further recesses 44 and 45 reduce the bulk of molding material and provide for more uniform molding. At each end, adjacent the bottom face 41 are small projections 46. The projections 46 have upwardly and outwardly inclined surfaces 47. The projections 46 act as snap retainers for retaining the connector member 16 in a recess 25 in a retracted position, that is with the connecting member in an upward, or non-connecting position, as in FIG. 1, position 18. This is obtained by the projections 46 moving in slots 48 formed in the front and rear walls 27 and 28.

Figure 11:
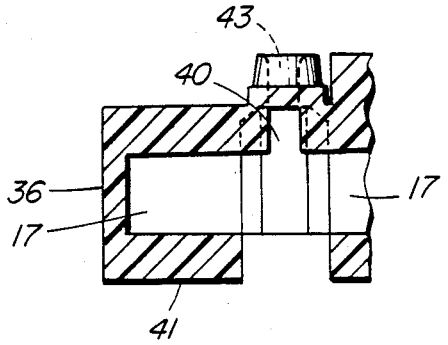
Figure 12:
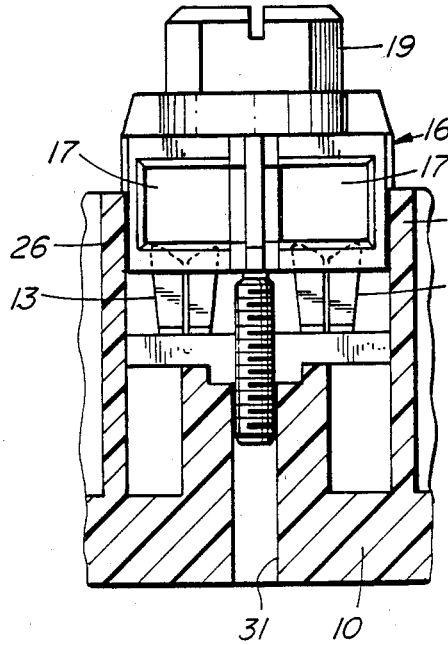
FIG. 12 is a view similar to that of FIG. 4, but with a connecting member assembled thereto, in an open position and terminals inserted.

FIG. 12 illustrates a connector member in its initial position in the body. The connector member is in an upward position in FIG. 13, with the terminals 13 just entering, at their upper ends, into the lower ends of slots 40 (FIG. 11). The threaded portion 51 of the screw 19 is also shown. In the example, the threaded portion 51 is formed by thread rolling after assembly to the connector member, and the screw 19 is thus retained in the bore 38 of the connector member.

Figure 13:
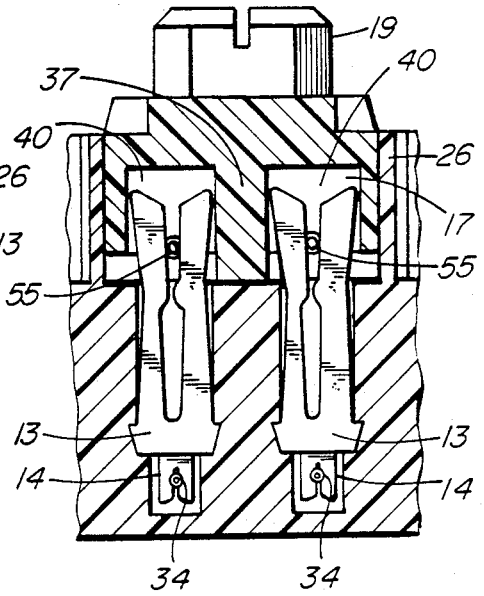
FIG. 13 is a view similar to that of FIG. 5, but with the connecting member in a closed, or connecting position.

FIG. 13 illustrates a connector member pushed in to its connecting position, after insertion of two conductors 55 into the passages 17. As the screw 19 is tightened down it pushes down the connector member which in turn pushes the conductors 55 down into the terminals, displacing insulation from the conductive core. There is thus provided an electrical connection between conductors 34 and the conductors 55.

Figure 14:
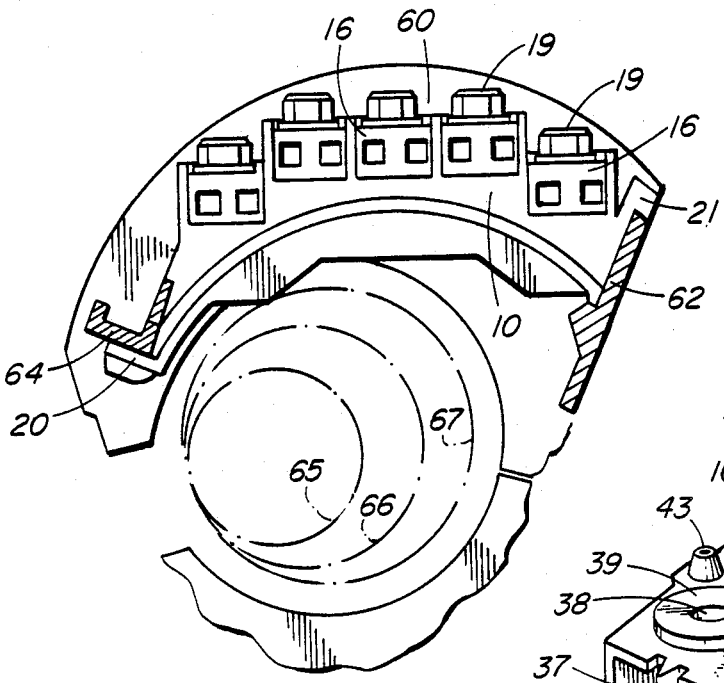
FIG. 14 illustrates a connector assembled to a terminal housing as used for aerial and other terminations.

FIG. 14 illustrates the mounting of a connector into an aerial terminal. The aerial terminal has a framework 60 and the projection 21 at one end of the connector extends through the framework and is positioned on a frame member 62. At the other end of the connector the projection 20 abuts a further frame member 64 and is attached thereto as by screws. The circles 65, 66 and 67 illustrate the diameter of different sizes of cables that can be accommodated in the terminal. The conductors 34 in FIGS. 5 and 14 extend from the cables at 65, 66 and 67. The connection positions extend somewhat in an arcuate arrangement to fit in a cylindrical housing.

Figure 15:
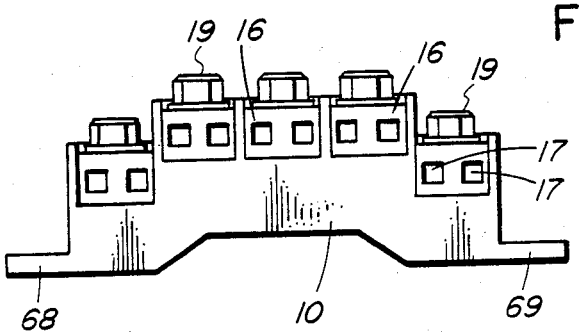
FIG. 15 illustrates a modified connector as used for pedestal mounting.

FIG. 15 illustrates a modified form of connector in which the body has two ribs or flanges 68 and 69 extending laterally, one at each end. The flanges 68 and 69 normally have holes therethrough for bolting to a frame in an enclosure. The form of connector illustrated in FIG. 15 would normally be used in a pedestal or similar enclosure, the connection positions extending in a straight line.

Figure 16:
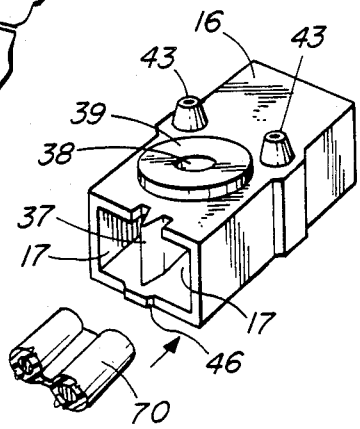
FIG. 16 illustrates a modification to a connecting member for splitting paired drop wires as they are inserted.

FIG. 16 illustrates a modification to a connecting member 16. The front end of the central wall 37 is given a sharp edge. This can be used to separate a paired conductor, at 70, into two separate conductors for entry into the passages 17. A metal insert can also be provided.

The holes 43 serve to admit test probes into the connector member. A probe inserted into a hole 43, in the connector member, will contact the top of a terminal and thus be connected to the conductors 34 and 55.

It will be appreciated that as the conductors 55 are inserted into the passages 17 of the connecting member, the connecting member pushes the conductors into the terminals a predetermined distance, set by the insertion of the connecting member into the related recess 25. Also, on withdrawal of the connecting member, by unscrewing of the screw 19, the conductors 55 will be pulled up out of the terminals. The conductors can then be pulled out of the passages 17. New conductors can be placed in the passages 17 and reconnected to the terminals.

Before or after insertion of the terminals 13, a sealant can be injected. Generally the sealant will be injected after insertion of the terminals. The sealant will be fed to the lower parts of the terminals via the stem portions of the T-shaped slots 32. The sealant will seal the connections between conductors 34 and the lower parts 14 (FIG. 13) and also the connections between conductors 55 and the upper parts of the terminals 13 (FIG. 13).

Figure 17:
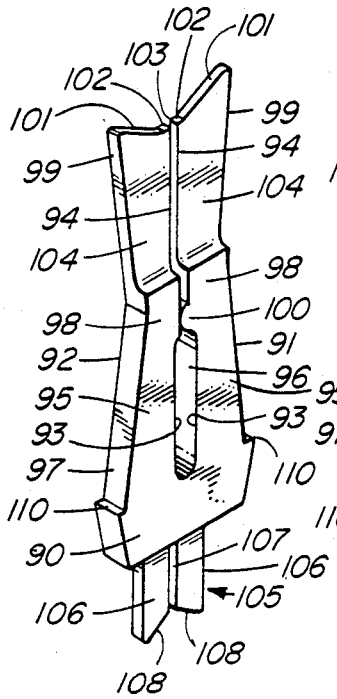
FIG. 17 is a perspective view of one form of terminal, as in the connector illustrated in FIG. 1.

As illustrated in FIG. 17, a terminal 13, as illustrated in FIG. 1, comprises a base 90 from which extend two cantilever contact members 91 and 92. The terminal conveniently is formed from flat strip material, with the contact members co-planar and having opposed edges which are in two parts, lower parts 93 and upper parts 94.

The upper and lower parts of the opposed edges correspond generally with upper and lower portions of the contact members. The lower portions 95 of each contact member are defined at the inner edges by a slot 96, the sides of the slot defined by the lower parts 93 of the opposed edges. The outer edges 97 of the lower portions 95 incline upward and inward from the base to a narrow, or neck, section 98 which is positioned just above the top end of the slot 96.

The upper portions are defined by the upper parts 94 of the opposed edges and by outer edges 99 which incline upward and outward from the narrow or neck section 98. Between the top end of the slot 96 and the narrow section 98, one of the terminal members is swaged at its inner edge, at 100. The swaging preloads the terminal members apart a small distance such that the upper parts 94 of the opposed edges are spaced slightly. The spacing of the upper parts 94 of the opposed edges is less than the diameter of the smallest size, or gage, of conductor to be inserted.

The upper portions 104 of the contact members are of reduced thickness relative to the lower parts and the base. The reduced thickness extends from slightly above the narrow section 98 up to the top edges 101 of the contact members. The top edges incline upward and outward from the opposed edges, therebeing a small section 102, extending from the opposed edge, normal thereto, on each contact member. The intersection of each section 102 with the related upper part 94 of the opposed edges defines a cutting edge 103 extending for the thickness of the upper portion of each contact member.

Extending from the base 90 in the opposite direction to the contact members 91 and 92 is a further terminal indicated generally at 105. This terminal has two legs 106 having spaced opposed inner edges 107. The lower edges 108 of the legs 106 incline upwards and inwards. In some instances the terminal 105 may not be provided, or may take some other form.

At each edge of the base 90 is formed a barb or tang 210. Terminals may be inserted in a connector, or other holder, by being pushed in. Once inserted the barbs or tangs 110 retain the terminal in position, against forces which can be applied when a conductor is pulled out from between the contact members 91 and 92. However, this is only one form of retaining a terminal in place. It is possible, for example, that terminals be held in position by barbs extending normally to the plane of the terminal. Also, terminals could be molded in place, with one or more holes extending through the base 90.

Figure 18:
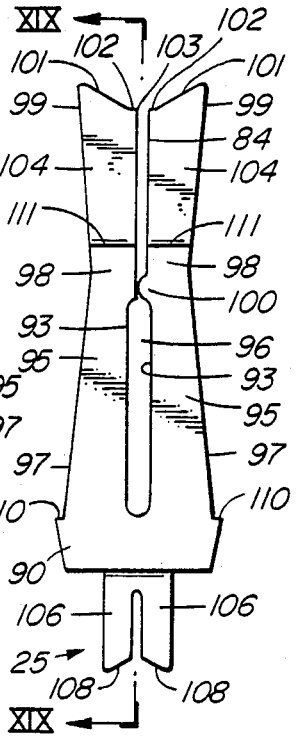
FIG. 18 is a front view of the terminal of FIG. 17.
Figure 19:
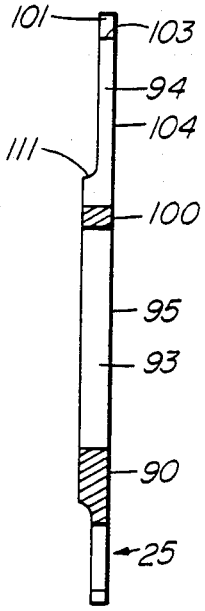
FIG. 19 is a cross-section on the line XIX—XIX of FIG. 18.

In FIG. 18 there is readily seen the slight spacing of the upper parts 94 of the opposed edges and also the relative positioning of the narrow section 98, swage 100 and the lower limit 111 of the reduced thickness of the upper portions of the contact members. FIG. 19 illustrates the reduced thickness of the upper portions and of the further terminal 105.

The terminal is used as follows. An insulated conductor is positioned on the top edges 101 of the contact members, being centered to some degree by the inclination of the top edges. As the conductor is pushed down between the opposed edges 94, the cutting edges 103 make short cuts in the insulation, parallel to the axis of the conductor. A section of insulation is then pushed up off of the conductor as the core of the conductor moves down between the edges 94. This is described and illustrated in U.S. Pat. No. 3,521,221, issued July 21, 1970 in the name of the present assignee. Forcing of the conductive core of the conductor down between the edges 94 forces the contact members 91 and 92 apart.

The use of different thicknesses of material for the upper and lower portions of the contact members provides several advantages. The reduced material thickness of the upper portions 104 results in a lower insertion force, as a result of a reduced area of contact between the conductive core and contact members. There is an increase in the ratio of normal force to material thickness at the entry point—cutting edges 103—which improves stripping of insulation. There is also an increase in the ratio of normal force to material thickness at the final position of rest of the conductor, giving a more stable connection. It also enables a smaller overall terminal.

Figure 21:
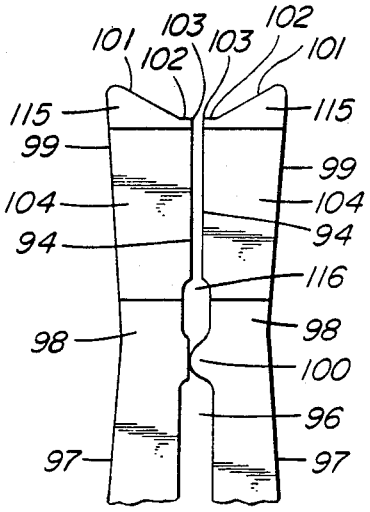
FIGS. 21 and 22 illustrate modifications to the terminal of FIG. 17.
Figure 22:
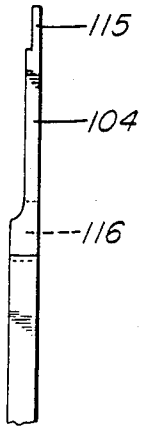

FIGS. 21 and 22 illustrate two modifications which can be made to the terminal as illustrated in FIG. 17. The two modifications can be made individually, or both may be made at the same time.

Firstly, for conductors having thick and/or hard insulation, the insertion force required to cause displacement of the insulation can be sufficient to cause damage to the terminal and/or the conductor. The terminal of the invention is intended to be capable of accepting a range of conductor sizes and types. To reduce the insertion force, or insulation displacement force, a modification is to reduce the thickness of the top parts of the upper portions 104. This is illustrated in FIGS. 21 and 22, the upper portions 104 being reduced in thickness at the top parts 115. The top parts are shown reduced in thickness, in the example, to about half the thickness of the rest of the upper portions. Reducing the thickness of the upper portions 104 of the cantilever members gives a shorter cutting edge 103 on each cantilever member, requiring a reduced initial insertion force to initiate cutting and displacement of insulation. As a conductor is pushed down between the opposed edges, further displacement of insulation occurs.

Also illustrated, in FIG. 21 particularly, is an enlargement or aperture 116 formed at the lower ends of the opposed edges 94. It can happen, particularly in cold temperatures, that the insulation on a conductor is hard. In such circumstances, the insulation trapped between the opposed edges 94, below the conductor core, instead of being squeezed out by the beam action of the cantilever contact members, remains between the contact members and acts as a wedge. As the conductor, and the insulation, is pushed down, the insulation can force the cantilever contact members apart to an extent which at least severely reduces the contact between the contact members and the conductive core of the conductor.

By providing the aperture or enlargement 116, the insulation below the core can be caused to be removed from between the edges 94. The conductor is inserted into the terminal by a tool which can be preset to determine where the conductor will be positioned beween the edges 94. Thus, the tool can be pushed down until a datum surface engages with the top of the terminal. This sets the position of the conductor. Therefore, the conductor can readily be inserted such that the conductive core is between the edges 94 just above the aperture 116, while the insulation below the core is in the aperture. The insulation will not then affect the contact conditions between the cantilever contact members and the core.

By positioning the narrow section 98 below the transition from reduced material thickness to normal thickness a reduction in stress concentration at the narrow section is obtained. The thicker material of the lower portions of the contact members and the tapered form gives more uniform stress distribution and increased compliance at entry and at conductor rest position.

The particular form of terminal provides a reusable member having improved elastic compliance and more uniformly distributed stresses. The terminal accepts a range of conductor sizes, e.g. 24 AWG to 18 AWG copper wire. The terminal also accepts and strips effectively a range of insulation materials, e.g. paper pulp, PVC and PVC/styrene butadune rubber. The terminal is smaller overall, resulting in a smaller package in use. The terminal is a relatively low cost, rugged, stamped member.

Figure 20:
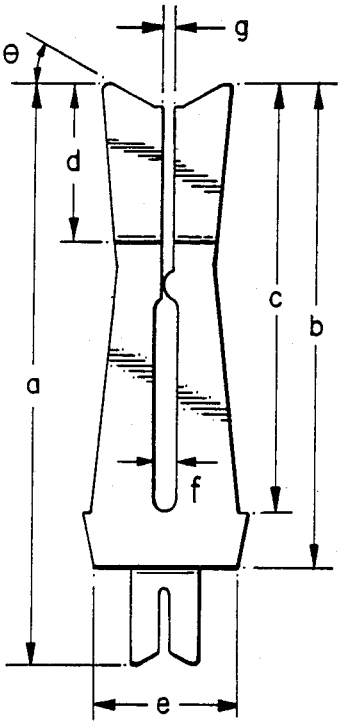
FIG. 20 illustrates the terminal, as in FIG. 18, with typical dimensions indicated.

Purely as an example, for the conductor sizes stated above, typical dimensions for a terminal are as follows, referring particularly to FIG. 20: (a) 0.804 inches; (b) 0.67 inches; (c) 0.61 inches; (d) 0.22 inches; (e) 0.195 inches; (f) 0.35 inches; (g) 0.007 inches; $\theta 30°$. The thickness of the main parts of the contact members 91 and 92 is 0.035 inches, while the thickness of the upper portions 104 is 0.016 inches. The thickness of the legs 106 is also 0.016 inches. The thickness of the top parts 115 is 0.008 inches. A typical material is berylium copper.

Figure 24:
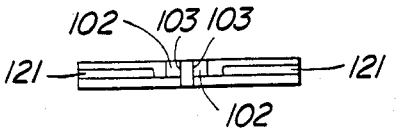
FIGS. 23, 24 and 25 are partial front view, top end view and side view, respectively, illustrating a further modification.
Figure 23:
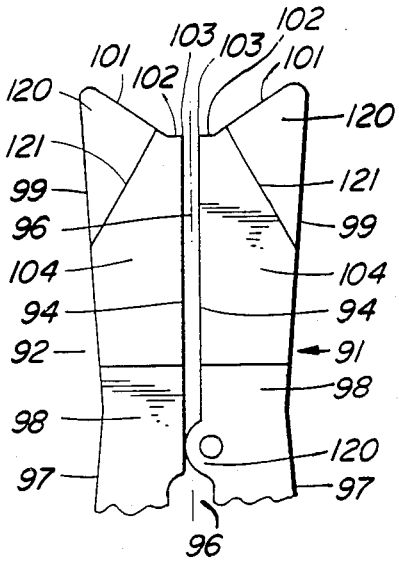
Figure 25:
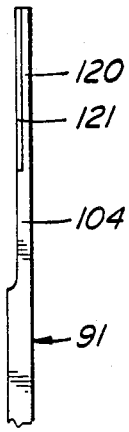

FIGS. 23, 24 and 25 illustrate a further modification, particularly, but not exclusively, suitable for a large gage drop wire, for example I8 AWG. Such drop wires have a relatively large insulation layer and this can be used to restrict deflection of the spring contact members. In FIGS. 23, 24 and 25, the same reference numerals are used to identify the same details as in FIGS. 17 and 21, where applicable.

Figure 7:
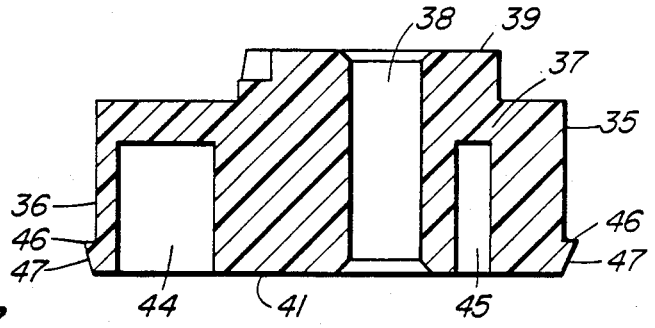
FIG. 7 is a cross-section on the line VII—VII of FIG. 6.
Figure 8:
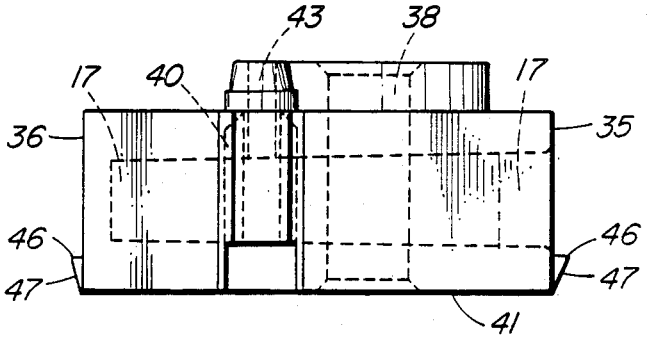
FIG. 8 is a side view of the connector member in the direction of arrow A in FIG. 6.
Figure 9:
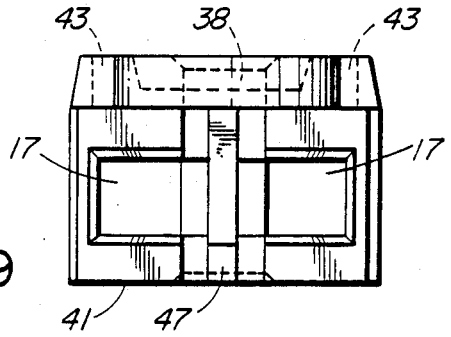
FIG. 9 is a front view of the connecting member in the direction of arrow B in FIG. 6.
Figure 10:
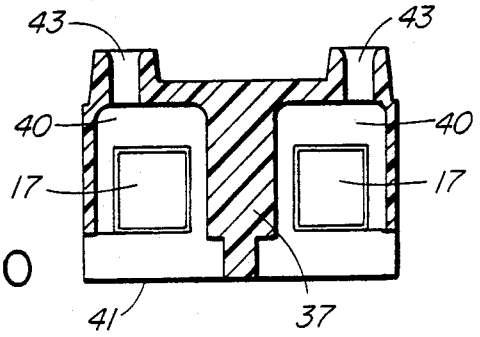
FIGS. 10 and 11 are cross-sections on the lines X—X and XI—XI respectively of FIG. 6.

As illustrated in FIGS. 23, 24 and 25, the upper portions 104 of the spring contact members 91 and 92 are of reduced thickness, as in FIG. 7. In the example in FIGS. 23, 24 and 25, the top upper angular portions or "horns" 120 are further reduced in thickness forming an inclined edge or ramp 121 extending downwardly and outwardly from the top edge 101 to the outer edge 99.

The reduced thickness of the outer parts of the edges 102 provides a better cutting action during the initial insertion of a drop wire, for example an 18 AWG drop wire. The remaining parts of the top edges and the flat sections 102 provide the required cutting forces for smaller gage wires, for example 22 and 24 AWG, with smaller overall insulation.

Figure 26:
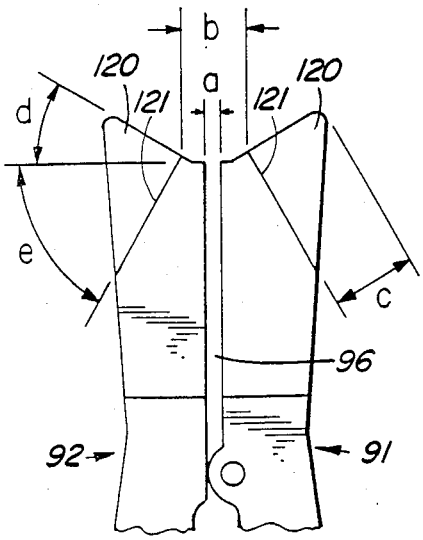
FIG. 26 illustrates the entry of a conductor into a terminal as in FIGS. 23, 24 and 25.

The ramp 121 becomes effective as a large drop wire is inserted. Initially, the insulation is cut into by the top edge 101. When the insulation meets the top end of the ramp 121—at 122, the insulation to the outside of the point 122 moves into contact with the ramp 121. This creates a wedge effect which opposes the effect of the upwardly and outwardly inclined top surfaces 101. This restricts bending or deflection of the contact members 91 and 92. The conductive core of the drop wire eventually enters the slot 96. FIG. 26 illustrates the condition of the conductor 123 just entered in the slot 96. The conductor 123 will be pushed down slightly further into the slot. The insulation 124, in the example, is D-shaped. A drop wire is conventionally a twin conductor structure, with the two conductors forming a single drop wire united by a thin web on the flat surfaces of the insulation. This web is slit before insertion of the conductor.

Figure 27:
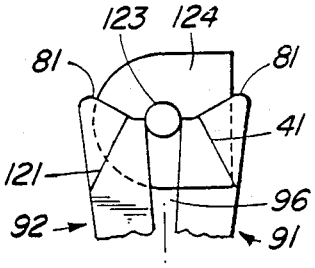
FIG. 27 is a view similar to that of FIG. 20 showing an example of dimensions for the modified terminal of FIGS. 23, 24 and 25.

The following dimensions and angles are typical values for an 18 AWG copperweld drop wire, referring to FIG. 27: (a) 0.011 inches; (b) 0.050 inches; (c) 0.065 inches; (d) 30°; (e) 60°. The thickness of the upper part 104 is about 0.016 inches and the thickness of the upper portions or "horns" 120 is about 0.008 inches.

The terminal as illustrated in FIGS. 23 to 27 will also be quite effective with large gage wires with circular cross-section insulation.

What is claimed is:

1. A cable terminal connector comprising:

an elongate connector body having a plurality of connection positions extending side-by-side along the body;

each connection position defined by a recess having front and back walls, transverse walls extending between the front and back walls, and a base; a pair of spaced bores extending transversely into said base from a front surface for reception of cable conductors; a pair of slots extending from the recess into said base, a slot aligned with and communicating with each transverse bore; a pair of slots extending down in said front wall from a top edge, a slot in said front wall aligned with a slot extending into said base; a threaded bore through said base, extending normal to said transverse bores; a terminal positioned in each of said slots extending into said base, each terminal including a lower connecting portion for connection to a cable conductor positioned in one of said bores extending transversely in said base and an upper connecting portion for connection to a drop wire conductor;

a connector member positioned in each recess, each connector member having: a pair of transverse bores extending from a front side, and a pair of slots extending up from a bottom surface and communicating with the transverse bores, the slots aligned with the upper connecting portions of the terminals in the recess;

a screw passing through the connector member from a top surface and entering said threaded bore.

2. A connector as claimed in claim 1, each connector position including a close-ended slot extending in the back wall and the front wall from adjacent to a top edge of each wall towards said base;

each connector member including a projection on a front side and on a back side, said projections positioned and slideable in said close-ended slots, whereby said connector member is retained in said recess.

3. A connector as claimed in claim 1, said pair of slots extending down in said front wall including chamfered edges for cutting into the insulation of a conductor positioned in a slot, to provide a strain relief.

4. A connector as claimed in claim 1, said connection positions extending in an approximately arcuate arrangement.

5. A connector as claimed in claim 1, said connection positions extending in a straight line arrangement.

6. A connector as claimed in claim 1, said connector member including two holes extending from a top face, each hole in communication with a said transverse bore in the connector member.

7. A connector as claimed in claim 1, said screw trapped in and freely rotatable in the connector member, whereby screwing in of said screw into said threaded bore pushes the connector member down into said recess and screwing out of said screw moves the connector member up to a withdrawn position in said recess.

8. A connector as claimed in claim 1, each said terminal comprising an insulation displacing terminal having two cantilever spring contact members, the contact members having opposed inner edges defining a conductor receiving slot, intersections of said inner edges and top edges at said contact members defining insulation slicing edges.

9. A connector as claimed in claim 1, including a pair of bosses extending up from said base into said recess at each connection position, said pair of slots extending from said recess extending through said bosses.

10. A connector as claimed in claim 9, including a further boss extending up from said base into said recess, said threaded bore extending through said further boss.

11. A connector as claimed in claim 10, said pair of bosses and said further boss forming a unitary formation.

12. A connector as claimed in claim 1, each said terminal comprising:

a base;

two cantilever spring contact members extending up from said base, the contact members having top edges and opposed inner edges between which a conductor is pushed, the intersections of said top edges and said opposed inner edges defining insulation slicing edges;

each contact member having a lower portion and an upper portion, the lower portions having upwardly and inwardly inclined outer edges and the upper portions having upwardly and outwardly inclined outer edges, the upper and lower portions congruent at a neck section;

a slot extending between the inner edges of the lower portions and a swage on one of said contact members on the inner edge thereof, the swage positioned immediately above said slot and spacing said inner edges of said upper portions slightly apart;

said upper portions being of reduced thickness relative to said lower portions for at least a major part of the distance from said top edges.

13. A connector as claimed in claim 12, said upper portions of said spring lever contact members each having a top part extending below and adjacent to said insulation slicing edges, said top parts being of reduced thickness relative to the remainder of the upper portions.

14. A connector as claimed in claim 12, including a further insulation displacing formation extending from said base, in an opposite direction to said cantilever spring contact members, said further insulation displacing formation comprising two cantilever legs having spaced opposed inner edges, said legs each having a lower edge inclined upward and inward to said inner edge.

15. A connector as claimed in claim 12, including barbs on said base, a barb formed at each side edge of said base, each barb defined by an upwardly and outwardly inclined side edge and an inwardly directed top edge merging into the outer edge of the lower portions of the spring contact member.

16. A connector as claimed in claim 12, said upper portions of said spring lever contact members each having a top upper part of reduced thickness relative to said reduced thickness of said upper portions, each said top upper part defined by an inclined edge extending downwardly and outwardly from the top edge to the outer edge.

17. A connector as claimed in claim 12, said swage positioned below and immediately adjacent to said neck section.

18. A connector as claimed in claim 17, said reduced thickness of said upper portions extending to a transition position adjacent to and immediately above said neck section.

19. A connector as claimed in claim 12, including an aperture formed between said spring contact members immediately above said swage, the aperture extending up between said upper portions.

20. A connector as claimed in claim 19, said aperture extending across the transition of thickness in said upper portions.

* * * * *